United States Patent [19]

Myers

[11] 4,206,884

[45] Jun. 10, 1980

[54] METHOD AND APPARATUS FOR FORMING A WOUND STRAND PACKAGE

[75] Inventor: John E. Myers, Anderson, S.C.

[73] Assignee: Owens-Corning Fiberglas Corporation, Toledo, Ohio

[21] Appl. No.: 46,079

[22] Filed: Jun. 6, 1979

[51] Int. Cl.[2] ..... B65H 54/02; B65H 54/28

[52] U.S. Cl. ..... 242/18 G; 242/43 R

[58] Field of Search ..... 242/18 G, 18.1, 43 R, 242/43.1, 43.2

[56] References Cited

U.S. PATENT DOCUMENTS

| | | | |
|---|---|---|---|
| 2,391,870 | 1/1946 | Beach | 242/18 G X |
| 3,315,904 | 4/1967 | Hardee | 242/43 R X |
| 3,402,898 | 9/1968 | Mattingly | 242/43 R |
| 3,549,096 | 12/1970 | Klink | 242/18 G |
| 4,060,208 | 11/1977 | Raasch | 242/18.1 |

*Primary Examiner*—Stanley N. Gilreath

*Attorney, Agent, or Firm*—Ronald C. Hudgens; Philip R. Cloutier; Ted C. Gillespie

[57] ABSTRACT

A method and apparatus for forming a wound strand package (20) comprise advancing a strand (14) to a rotating collet (22), reciprocating strand (14) in the direction of the axis of rotation (23) of the collet (22) by the action of strand oscillator (26) rotating at a first speed to lay the strand (14) onto the collet (22) in a helical pattern. reciprocating the strand oscillator (26) to lay the strand (14) onto the collet (22) in courses and rotating the strand oscillator (26) at a second speed less than the first speed during the winding of the first course of the strand (14).

8 Claims, 3 Drawing Figures

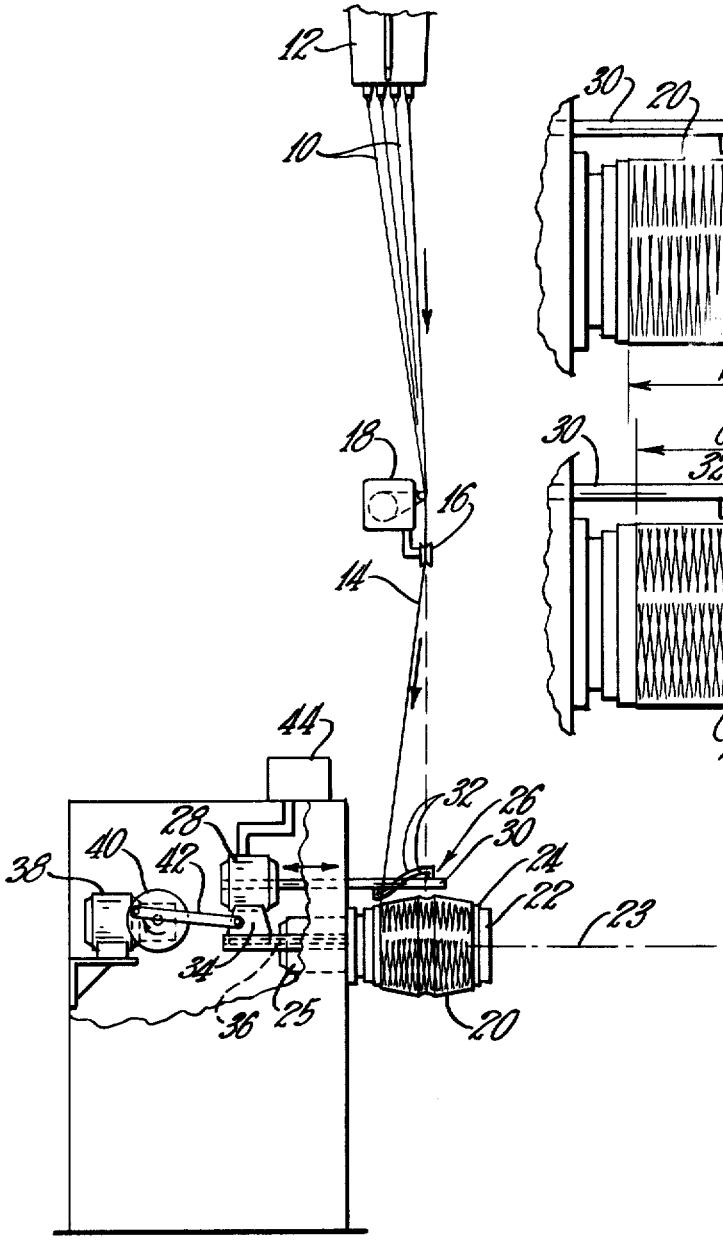
FIG. 1
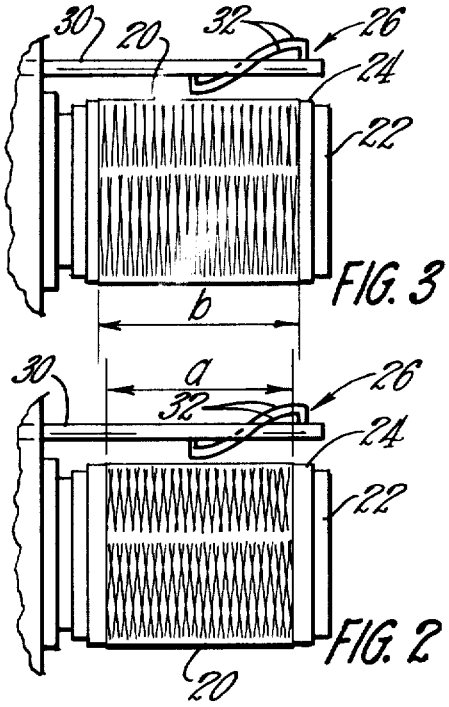
FIG. 3
FIG. 2

METHOD AND APPARATUS FOR FORMING A WOUND STRAND PACKAGE

TECHNICAL FIELD

This invention relates to the forming of wound strand packages. In one of its more specific aspects, this invention relates to the winding of strand packages in which a continuous strand of glass fibers is advanced to a rotating collet to form a wound package thereon. In one of its most specific aspects, this invention relates to reciprocating the strand in the direction of the axis of rotation of the collet by the action of a strand oscillator to form a helical pattern suitable for permitting the withdrawing or unwinding of the strand from the package without entanglement of the strand.

BACKGROUND OF THE INVENTION

A common method of collecting strand material, particularly strands of glass fibers, involves advancing the strand to a cardboard tube mounted on a rotating collet, and oscillating the strand with a rotating strand oscillator of the spiral wire type, which usually is comprised of a rotating shaft containing two outboard wires approximating a spiral configuration. The spiral wires of the strand oscillator strike the advancing strand and direct it laterally back and forth along the length of the collet in the direction of the axis of rotation of the collet. The rotating spiral wire strand oscillator commonly is adapted for reciprocation in the direction of the axis of rotation of the collet. The reciprocation of the strand oscillator causes the strand to be laid on the collet in layers or courses, thereby providing a secondary building motion which facilitates the winding of relatively long strand packages.

One of the characteristics of strand collecting apparatus utilizing a rotating strand oscillator is that the tension of the strand becomes increasingly greater during the packaging process. The strand tension increases because the build-up of the strand on the collet increases the diameter of the package, thereby increasing the angle of wrap of the strand around the spiral wire. A consequence of the increasing tension of the strand during the packaging process is that the area of distribution on the collet over which the strand is distributed becomes longer along the length of the collet. It is believed that the increased strand tension in the later stages of the winding process causes the strand to slide further from side to side during contact with the spiral wire, and thereby get thrown or forced farther and farther along the length of the collet. As a result of this longer distribution during the later stages of packaging, a portion of the strand in the later courses of strand packaging is being exposed to the cardboard tube mounted on the collet and upon which the strand package is wound. This contact with the cardboard tube by some of the strand during the later stages of packaging results in contamination by the cardboard tube and excessive migration of liquid coatings contained on the strand.

It has been found that the rotation of the strand oscillator at a lower speed than the speed at which the oscillator is rotated during normal winding causes a longer distribution of the strand on the collet. Therefore, by rotating the strand oscillator at a lower speed during the first few courses of the strand, the first few courses will be of sufficient length on the collet to prevent contact with the cardboard tube by later courses.

SUMMARY OF THE INVENTION

According to this invention there is provided a method for forming a wound strand package in which a strand is advanced to a rotating collet to form a wound package thereon, the strand is reciprocated in the direction of the axis of rotation of the collet by the action of a strand oscillator rotating at a first speed to lay the strand onto the collet in a helical pattern, the strand oscillator is reciprocated in the direction of the axis of rotation to lay the strand onto the collet in courses, and the strand oscillator is rotated at a second speed less than the first speed during the winding of the first course of the strand.

In one of its specific embodiments, the second speed of rotation of the strand oscillator is within the range of from about 30% to about 70% of the first speed of rotation.

In its preferred embodiment, the second speed of rotation of the strand oscillator is about 50% of the first speed of rotation.

In one of its specific embodiments, the strand oscillator is rotated at the second speed during the winding of the first few courses of the strand on the collet.

According to this invention there is also provided apparatus for forming a wound strand package in which a strand is advanced to a rotating collet to form a wound package thereon, whereby the strand is reciprocated in the direction of the axis of rotation of the collet by the action of a strand oscillator rotating at a first speed to lay the strand onto the collet in a helical pattern, and the strand oscillator is reciprocated in the direction of the axis of rotation to lay the strand onto the collet in courses, and further comprising means for rotating the strand oscillator at a second speed during the winding of the first course of the strand, the second speed being less than the first speed.

In a specific embodiment of the invention, the means is adapted to rotate the strand oscillator at a speed which is within the range of from about 30% to about 70% of the first speed of rotation.

In a preferred embodiment, the means is adapted to rotate the strand oscillator at a speed which is about 50% of the first speed of rotation.

In one of its specific embodiments, this invention employs means for rotating the strand oscillator at the second speed of rotation during the winding of the first few courses of the strand.

DESCRIPTION OF THE DRAWINGS

FIG. 1 is a partially cut away schematic view in elevation of the apparatus for forming and collecting strands of fibrous glass according to the principles of this invention.

FIG. 2 is a detailed view of the collet of FIG. 1 where the strand oscillator was rotating at a first speed and the first course has been laid on the collet.

FIG. 3 is a detailed view of the collet of FIG. 1 in which the first course has been laid on the collet while the strand oscillator was rotating at a second speed which is less than the first speed.

DESCRIPTION OF THE INVENTION

FIG. 1 shows apparatus for forming and collecting strands in which fibers 10 are drawn from bushing 12 and gathered into strand 14 by means of gathering member 16. A size suitable for coating the fibers can be applied to the fibers by any suitable means, such as size applicator 18. The strand is wound into package 20 by the rotation of collet 22. The collet is adapted to be rotated about axis of rotation 23 by any suitable means, such as motor 25. Any suitable package core material, such as cardboard tube 24 can be positioned on the collet to receive the strand package.

Strand oscillator 26 is positioned to contact the strand and reciprocate it in the direction of the axis of rotation of the collet. The strand oscillator is adapted to be rotated by motor 28, although any suitable means for rotating the strand oscillator would suffice. Although the invention is not limited to any particular type of rotating strand oscillator, in the preferred embodiment, the strand oscillator comprises rotatably mounted shaft 30 upon which are mounted two outboard spiral wires 32 which are adapted to strike the advancing strand and direct it laterally back and forth along the length of the collet. The effect of the rotation of the strand oscillator is to lay the strand onto the collet in a helical pattern suitable for the withdrawing or unwinding of the strand from the package without entanglement.

The strand oscillator is adapted for reciprocation in the direction of the axis of rotation of the collet. This can be accomplished by mounting motor 28 on support 34 which itself is slidably mounted in guideway 36. The reciprocation of the strand oscillator and motor 28 can be effected by the action of any suitable means such as motor 38 which is operatively connected to the support by cam 40 and link member 42. The effect of the reciprocation of the strand oscillator is to lay the strand onto the collet in courses.

Controller 44 is operatively connected to motor 28 and is adapted to control the speed of motor 28 during the formation of the wound strand package. The controller can be adapted with a timer to provide the proper sequence of speeds for motor 28. Numerous devices suitable for controlling the speed of the motor are commercially available, and can be readily adapted for the purposes of this invention. During normal formation of a wound strand package, the strand oscillator is rotated at a first speed. As the strand oscillator is reciprocated, the first course will be laid on the collet or cardboard tube. As shown in FIG. 2, the length of the first course is indicated by the distance "a". FIG. 3 shows the collet having the first course laid thereon under conditions in which the strand oscillator is rotating at a second speed, which is less than the first speed. The length "b" of the first course of the strand laid on the collet is greater than the length "a" of the first course in FIG. 2 laid on the collet under conditions of rotation of the strand oscillator at the first speed.

Typically, normal packaging conditions require the spiral wire to rotate within the range of from about 850 to about 1700 revolutions per minute. It has been found that the rotation of the spiral wire during the application of the first course of strand can effectively utilize the principles of the invention when the second speed of rotation is within the range of from about 30% to about 70% of the first speed of rotation. In the preferred embodiment, the controller is adapted to drive motor 28 so that the strand oscillator rotates at a second speed which is approximately 50% of the first speed.

In one embodiment of the invention, the controller is adapted to drive the spiral wire at a second speed of 425 revolutions per minute during the first few courses, and then drive the strand oscillator at a speed of 850 revolutions per minute during the remaining 32 minutes of the packaging cycle.

Although the invention has been found to be quite suitable for forming a wound strand package of continuous strands of glass fibers, the principles of the invention apply to other types of strands, and to strands of other kinds of materials. It can be appreciated, in view of the above, that various modifications can be made to this invention. All such variations are intended to be encompassed, however, by the claims herein.

I claim:

1. The method of forming a wound strand package (20) of the type in which a strand (14) is advanced to a rotating collet (22) to form a wound package (20) thereon, and wherein said strand (14) is reciprocated in the direction of the axis of rotation (23) of said collet (22) by the action of a strand oscillator (26) rotating at a first speed to lay said strand (14) onto said collet (22) in a helical pattern, and wherein said strand oscillator (26) is reciprocated in the direction of said axis of rotation (23) to lay said strand (14) onto said collet (22) in courses, the improvement comprising: rotating said strand oscillator (26) at a second speed less than said first speed during the winding of the first course of said strand (14).

2. The method of claim 1 in which said second speed is within the range of from about 30% to about 70% of said first speed.

3. The method of claim 2 in which said second speed is about 50% of said first speed.

4. The method of claims 1, 2 or 3 in which said strand oscillator (26) is rotated at said second speed during the winding of the first few courses of said strand (14).

5. Apparatus for forming a wound strand package (28) of the type in which a strand (14) is advanced to a rotating collet (22) to form a wound package (20) thereon, and in which said strand (14) is reciprocated in the direction of the axis of rotation (23) of said collet (22) by the action of a strand oscillator (26) rotating at a first speed to lay said strand (14) onto said collet (22) in a helical pattern, and in which said strand oscillator (26) is reciprocated in the direction of said axis of rotation (23) to lay said strand (14) onto said collet (22) in courses, the improvement comprising: means (44) for rotating said strand oscillator (26) at a second speed during the winding of the first course of said strand (14), said second speed being less than said first speed.

6. The apparatus of claim 5 in which said means (44) is adapted to rotate said strand oscillator (26) at a speed which is within the range of from about 30% to about 70% of said first speed.

7. The apparatus of claim 6 in which said means (44) is adapted to rotate said strand oscillator (26) at a speed which is about 50% of said first speed.

8. The apparatus of claims 5, 6 or 7 in which said means (44) rotates said strand oscillator (26) at the second speed during the winding of the first few courses of said strand (14).

* * * * *